US010154764B2

(12) United States Patent
Khaytman

(10) Patent No.: US 10,154,764 B2
(45) Date of Patent: Dec. 18, 2018

(54) PORTABLE ADJUSTABLE SLIDE-RESISTANT BACK AND NECK SUPPORT FOR TOILET SEAT LIDS

(71) Applicant: Eddi Khaytman, North Haledon, NJ (US)

(72) Inventor: Eddi Khaytman, North Haledon, NJ (US)

( * ) Notice: Subject to any disclaimer, the term of this patent is extended or adjusted under 35 U.S.C. 154(b) by 260 days.

(21) Appl. No.: 14/805,517

(22) Filed: Jul. 22, 2015

(65) Prior Publication Data

US 2016/0022100 A1 Jan. 28, 2016

Related U.S. Application Data

(60) Provisional application No. 62/128,727, filed on Mar. 5, 2015, provisional application No. 62/027,373, filed on Jul. 22, 2014.

(51) Int. Cl.
*A47K 17/02* (2006.01)

(52) U.S. Cl.
CPC ..... *A47K 17/02* (2013.01)

(58) Field of Classification Search
CPC ..... A47K 17/02
USPC ..... 4/254; 297/352, 230.11–230.14, 230.1
See application file for complete search history.

(56) References Cited

U.S. PATENT DOCUMENTS

| | | | | |
|---|---|---|---|---|
| 1,726,417 A | | 2/1929 | Wren | |
| 2,304,349 A | * | 12/1942 | Fox | A47C 7/425 297/230.14 |
| 2,582,321 A | | 11/1947 | Farrell | |
| 3,014,761 A | * | 12/1961 | Otto | A47C 7/425 297/230.12 |
| 3,263,245 A | | 8/1966 | Ettinger | |
| 3,279,849 A | | 10/1966 | Radke et al. | |
| 3,977,028 A | | 8/1976 | Chang | |
| 4,597,386 A | | 7/1986 | Goldstein | |
| 4,819,278 A | | 4/1989 | Ramos | |
| 5,190,347 A | | 3/1993 | Shiow-Lan | |
| 5,398,993 A | | 3/1995 | Chen | |
| 5,462,334 A | * | 10/1995 | Sedorcek | A47C 9/06 297/252 |
| 5,533,787 A | | 7/1996 | Xiang | |
| 5,809,582 A | | 9/1998 | Lane | |
| D446,289 S | * | 8/2001 | Dabner | D23/311 |

(Continued)

FOREIGN PATENT DOCUMENTS

| | | |
|---|---|---|
| EP | 0435463 A1 | 7/1991 |
| EP | 1908385 A1 | 4/2008 |

*Primary Examiner* — Christine Skubinna
(74) *Attorney, Agent, or Firm* — Gearhart Law LLC

(57) ABSTRACT

A support device is disclosed that solves the problem of conventional toilet seats lacking proper back and neck support for individuals with back and neck ailments. The support device provides a portable and adjustable toilet seat back and neck support device comprising a lumbar support portion, an adjustment portion and a neck support portion. The lumbar support portion is designed relieve pressure on the lower back. The adjustment portion connects the lumbar support portion and the neck support portion and provides an adjustment means for proper alignment of the spine. When in use the device is affixed to a toilet seat lid cover via fastening-loop material disposed on the lumbar support portion. When not in use the device is designed to be collapsible for discreet storage.

8 Claims, 9 Drawing Sheets

(56) References Cited

U.S. PATENT DOCUMENTS

| | | | | |
|---|---|---|---|---|
| 7,213,884 | B2 * | 5/2007 | Flory | B60N 2/4882<br>297/216.12 |
| 8,261,384 | B2 | 9/2012 | Batiste et al. | |
| 2002/0096929 | A1 * | 7/2002 | Showerman | A47C 7/38<br>297/423.12 |
| 2012/0126605 | A1 * | 5/2012 | Gross | B60N 2/4817<br>297/410 |
| 2012/0304370 | A1 | 12/2012 | Gianfagna et al. | |

* cited by examiner

PORTABLE ADJUSTABLE SLIDE-RESISTANT BACK AND NECK SUPPORT FOR TOILET SEAT LIDS

CLAIM OF PRIORITY

This application claims priority to U.S. Application 62/128,727 filed on Mar. 5, 2015 and U.S. Application 62/027,373 filed on Jul. 22, 2014, the contents of both of which are herein fully incorporated by reference in its entirety.

FIELD OF THE EMBODIMENTS

The present invention and its embodiments relate to a device that provides back and neck support and it's method of use. In particular, the present invention relates to providing neck and back support for a user when used in conjunction with a traditional toilet.

BACKGROUND OF THE EMBODIMENTS

The lids of conventional toilet seats do not provide sufficient back or neck support for many of its users. Typically, when one sits down to use a traditional household toilet, the toilet seat rests parallel to the ground while the lid of the toilet is raised up, leaning on the top portion of the toilet's tank or the tank's lid. These toilet lids have a hardened surface and have a completely straight slope; this renders the lid incapable of providing adequate back support by virtue of the fact that the lid does not conform to the curvatures of a user's spine. Moreover, the slope of the lid does not encourage correct posture, nor does it relieve pressure from a user's spine when in a seated position. Further, in most cases, even if the lid of the toilet seat does conform to the curvatures of a user's spine, frequently the lid is positioned too far away for a user to rest their back on it.

Afflictions of the back, particularly those of the lower back, are a prominent issue in today's society. It has been shown that sitting with incorrect posture, especially for prolonged periods of time, can cause new back ailments and can exacerbate preexisting ones. Specifically, these issues can lead to back strain, neck strain, muscular pain, and other musculoskeletal ailments. Leaning on the conventional toilet lid for support while using a toilet results in incorrect spine alignment as well as incorrect weight distribution.

To avoid these problems, one should endeavor to sit with proper posture. This entails maintaining the natural curvature of one's lumbar, thoracic, and cervical spine and distributing one's body weight evenly on both hips, all while maintaining proper spinal alignment. More specifically, to maintain correct posture while in a seated position, one's neck (cervical spine) should be vertical and approximately in line with their torso (thoracic spine) and lumbar spine. Further, one's ears should also be in alignment with their shoulders while in this position.

As noted, one's neck also plays an integral role in maintaining proper spine alignment. This is because improper positioning of the neck causes great difficulty in maintaining correct posture, which in turn has a strong effect on spinal alignment. This aspect of maintaining spine alignment is often overlooked in existing portable back supports. When one is forced to sit for a prolonged period of time without proper neck support, people tend to compensate by leaning the head forward. Forward-leaning head posture can result in the misalignment of one's spine resulting in chronic pain, numbness in the hands or arms, as well as pinched nerves and improper, inefficient breathing.

Notwithstanding the above, most individuals who attempt to sit in this ideal sitting position for a prolonged time without proper back support will experience musculoskeletal discomfort. This is due to the atypical stress placed on one's musculoskeletal system while engaging in this ideal sitting position.

Neither back support cushions nor neck support cushions presently in use adequately provide support for a toilet seat user's back and neck. This is in part due to the slope of the lid that exists while the lid rests on the toilet's tank, as well as the relatively large distance between the posterior spine of a user sitting in a correct upright posture and the tilted lid of the toilet seat. Also, portable back supports in present use have the problem of sliding relative to the toilet lid when the pressure of the back is applied to them. Therefore, they lack the necessary stability to provide proper support.

Complex orthopedic back supports may address some of the aforementioned issues with back support cushions, but those supports are very expensive and in many cases impractical. The majority of these back support devices are difficult to set up and require awkward movements that can further aggravate back ailments. Also, setting up these devices is frequently time-consuming and for an individual who is seeking to utilize the toilet, time can be a highly sensitive issue.

Additionally, if one leaves one of the aforementioned complex support devices on the toilet at all times, it limits the ability to utilize the toilet in a normal manner. Further, many individuals want to be discreet about their back ailments and find having an orthopedic device attached to their toilet at all times undesirable. Finally, users are currently unable to adapt these devices to toilets outside the user's home without carrying or traveling with these devices all while taking the time and effort to install them prior to each use.

While several of the inventions in the prior art have attempted to address these drawbacks, detailed above, none adequately address all of the aspects of a successful portable adjustable slide-resistant back and neck support for use on a conventional toilet seat. The present invention and its embodiments provide for proper and comfortable back and neck support for a user on a toilet that allows said user to maintain correct posture while alleviating the undesired symptoms such as back discomfort and encouraging proper biomechanics of the back and neck. The disclosed invention may be adapted for use on other structures intended for sitting such as chairs, benches, etc.

REVIEW OF THE PRIOR ART

U.S. Pat. No. 4,819,278 pertains to an invalid commode support apparatus wherein a neck support, either integrally secured to or separate from an associate back support, are each securable to an upright plumbing supply, as utilized in commercial commode devices, such as in hospitals. A plurality of Velcro securement straps are securable about an individual utilizing the apparatus wherein optionally employable pivotal arms are secured at either side of the aforementioned back rest portion of the apparatus.

U.S. Pat. No. 3,977,028 pertains to a back rest that s movably supported on a wall behind a toilet in a manner whereby in one position the hack rest is above the toilet and free therefrom and rests against the wall and in another position the hack rest over the raised toilet lid in juxtaposition therewith and supports the back of a user of the toilet.

U.S. Pat. No. 5,533,787 pertains to an adjustable back support device that has a seat cover snugly enclosing the seat back of a car seat, and a basic set of three cushions. The seat cover and the shells of the cushions are made of fastening-loop fabric. The cushions also include fastening-hook strips disposed thereon, so that they can be individually attached to the seat cover for supporting different parts of a user's body, such as the neck, upper back, and lumbar area. The cushions can be easily and precisely positioned to suit individual users, and can be attached anywhere on the seat cover for supporting other parts of a user's body. Fewer or more cushions can be used if desired to suit individual preferences.

Various devices are known in the art. However, their structure and means of operation are substantially different from the present disclosure. The other inventions also fail to solve all the problems taught by the present disclosure. The present invention differs from the prior art in several aspects. In addition to the back support, the present invention incorporates head and neck support for a toilet user. Prior inventions for toilet users provide back support, but do not also offer head and neck support. Additionally, prior inventions that do include neck support and back support are not in the same field of invention. These seats/attachments do not focus on toilet usage and the associated therapeutic effects of sufficient support and comfort; they focus on support and for general sitting.

SUMMARY OF THE EMBODIMENTS

In one embodiment there is a support device, having a back support cushion, having a front surface, a back surface, a first riser having a top and bottom end; a second riser having a top and bottom end; a head and neck support cushion, having a front end, a back end, a top surface and a bottom surface, wherein said bottom surface is equipped with a first slot and a second slot; a rigid back panel, having a top end, and a bottom end, wherein said top end is equipped with a first slot and a second slot, wherein said bottom end of said first adjustable arm and said bottom end of said second adjustable arm are capable of being inserted into the first slot, wherein said bottom end of said second adjustable arm and said bottom end of said second adjustable arm are capable of being inserted into the second slot.

In another embodiment, the present invention contemplates a support device, comprising: a rigid back member; a back cushion, attached to said rigid back member; a back slip cover, covering said back cushion; at least one riser, slidably coupled to said rigid back member; at least one clamp, attached to said at least one riser; an adjustment mechanism, attached to said at least one riser; a head cushion attached to said adjustment mechanism; a head slip cover, covering said head cushion; and a strap, attached to said back cushion and/or said rigid back member. In an alternative embodiment, this support device further comprises at least one rubber pad attached to said at least one riser.

In a preferred embodiment, the clamp of the present invention is comprised of a hook, having a bend, a plurality of tips, and a receiving hole; a plurality of rubber grips, affixed to said plurality of tips; a tension knob, inserted into said receiving hole, such that it is capable of exerting tensile force upon said hook; and a locking knob, inserted into said receiving hole. In another preferred embodiment, the adjustment mechanism of the present invention is comprised of: a spring loaded ratchet, comprised of a gear and a pawl; a release button configured to engage the pawl; and a housing to enclose said adjustment mechanism.

The present disclosure also contemplates a method of supporting a user of a toilet's spine, comprising the steps of: securing, a support device to a toilet; positioning, a user to use said toilet; aligning, a head and a neck of a user with a neck and head support cushion or said support device; optimizing, the contact angle between said head and said neck with said neck and head support cushion; aligning, a back of said user with a back support cushion.

It is an object of the present invention to improve one's posture while sitting.

It is an object of the present invention to provide back support.

It is an object of the present invention to provide neck and head support.

It is an object of the present invention to relieve stress on the musculoskeletal system.

DESCRIPTION OF THE PREFERRED EMBODIMENTS

Figure 1:
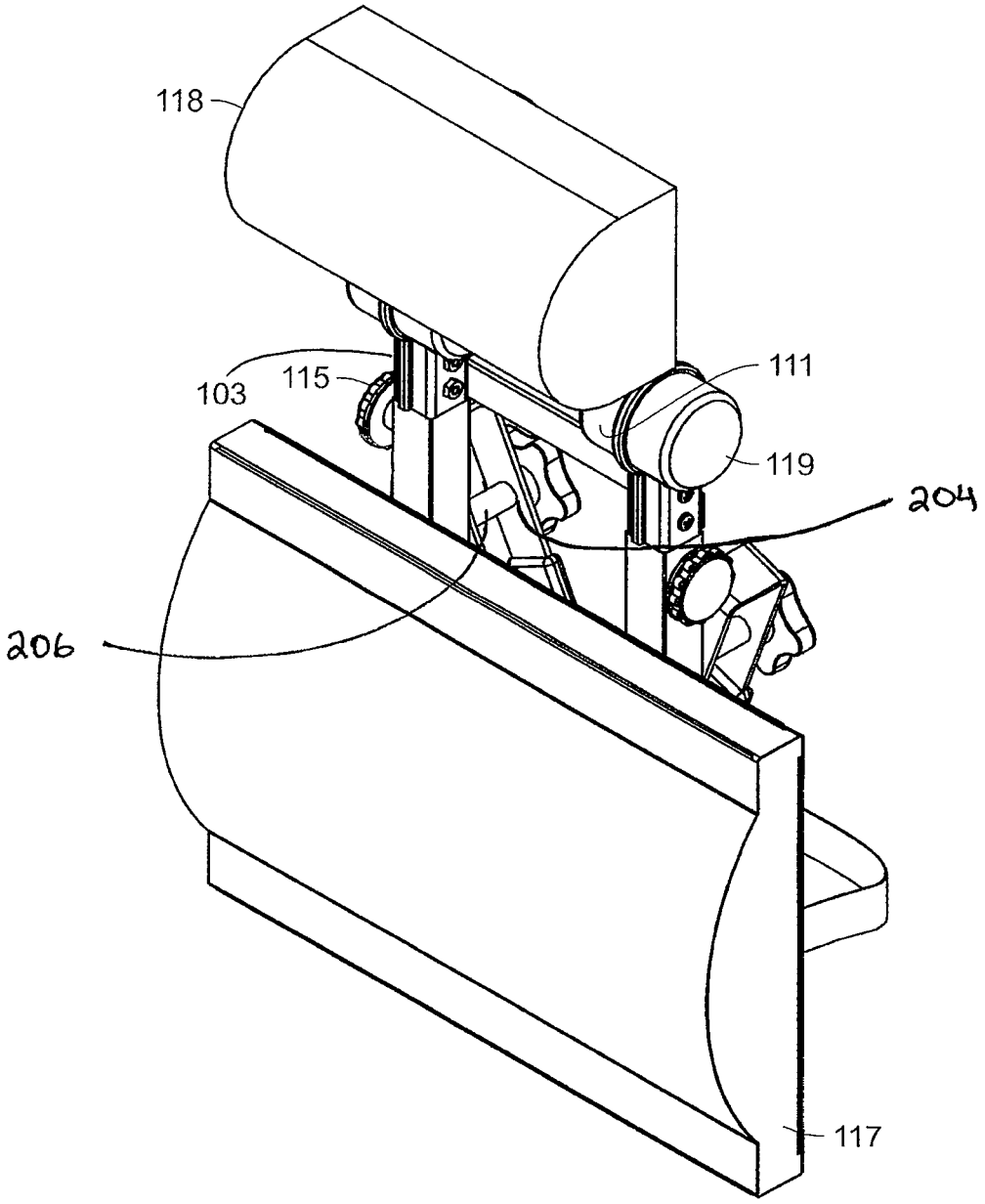
FIG. 1 is a front perspective view of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

FIG. 1 shows a perspective view of an embodiment of the present invention. Here, head slip cover 118 and back slip cover 117 are highlighted. Each slip cover covers a head and neck support cushion 102 (see FIG. 2) and a back support cushion 101 (see FIG. 3). Further, an alternative embodiment of adjustment mechanism 111 is shown. This embodiment is equipped with release button 119 which releases the pawl (not pictured) inside adjustment mechanism 111. Locking knob 115 is also shown in FIG. 1. Locking knob 115 is used to secure the position of the risers 103 once the desired height of the risers 103 has been determined.

Figure 2:
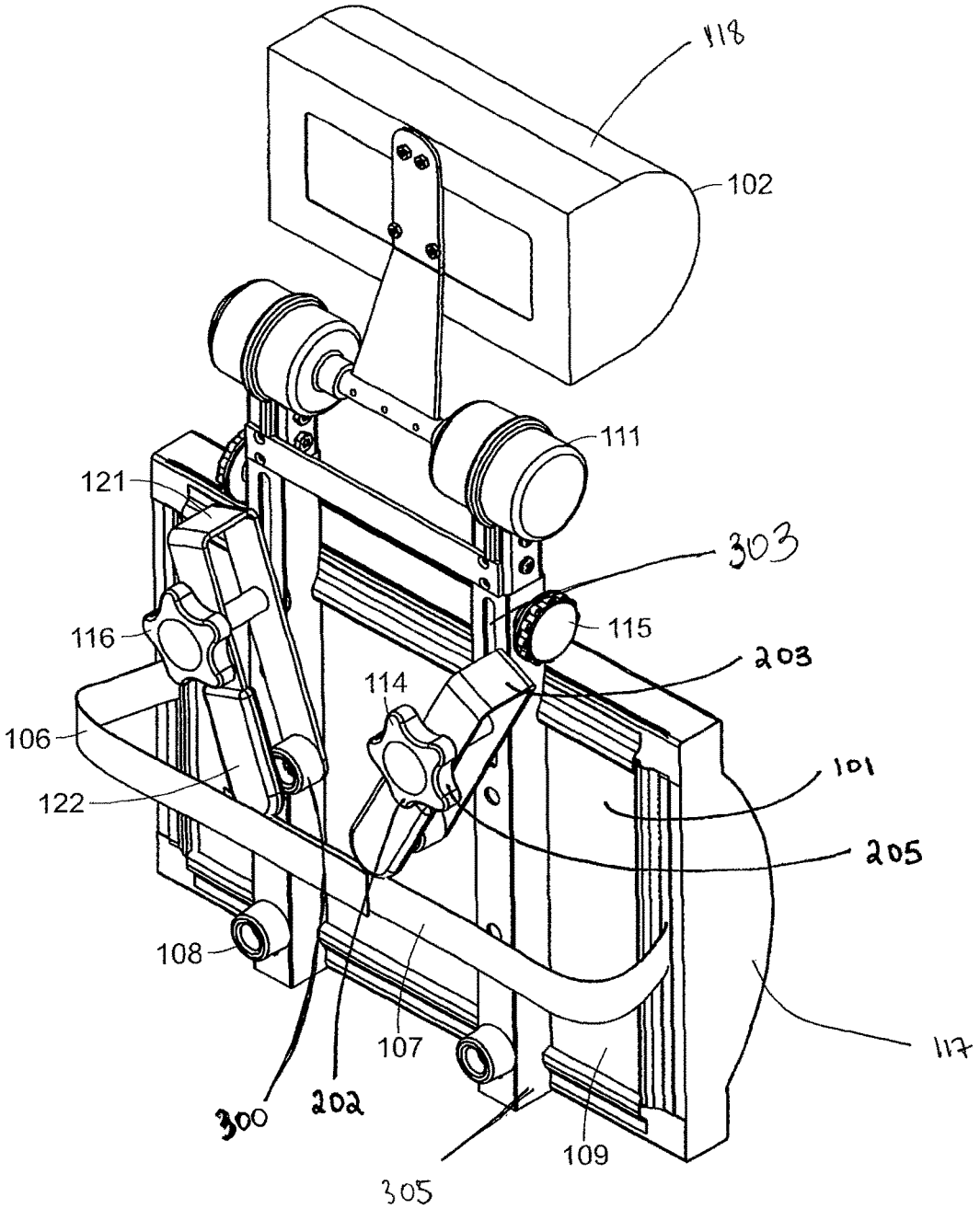
FIG. 2 is a rear perspective view of an embodiment of the present invention.

Referring to FIG. 2, a rear perspective view of an embodiment of the present invention is shown. As in FIG. 1, adjustment mechanism 111 is shown, along with head and neck support cushion (head cushion) 102, and rigid back panel 109. The adjustment mechanism 111 allows for rotational movement of the head and neck support cushion 102. The degree of rotational freedom may vary with the construction of the device but is preferably between about 270° and about 360°. In some instances the head and neck support cushion 102 and its support is of a shape that allows it to rotate freely through the risers 103 (see FIG. 1) and lock in at virtually any position desired by the user. In other embodiments, the adjustment mechanism 111 may lock in the neck support cushion 102 at predetermined positions.

A plurality of hook fasteners 106 and plurality of loop fasteners 107 are further shown. In one embodiment, the straps equipped with plurality of hook fasteners 106 and plurality of loop fasteners 107 are attached by being located between rigid back panel 109 and back support cushion 101 (not pictured). This prevents the need for any sewing and limits the amount of surfaces that need to be cleaned. The strap may also be located at any point along the rigid back panel 109. Thus, in some instances, the strap may be centrally located whereas in others it may be offset towards an upper end or lower end of the rigid back panel 109. Further, by having the strap positioned between the rigid back panel 109 and back support cushion 101 (see FIG. 3), the cushion may be interchangeable thereby supporting various cushion configurations and support levels (soft v. hard) as needed.

Also seen in FIG. 2, are the risers 103 being inserted into the rigid back members 305. The rigid back members 305 being fixedly coupled to the back support cushion 101. The risers 103 being slidably coupled to the rigid back members, with locking knob 115 for locking the risers in position. Tension knob 116 allows the hooks to be locked in a desired position. Padding members 300 help keep the support device positioned against the toilet seat.

In some embodiments, both cushions (back and neck) are interchangeable and the cushion may be selected for its properties such as amount of lumbar support, material, material density, and the like or some combination thereof. The cushions may be attached via conventional means including but not limited to hook and loop fasteners, snaps, magnets, clips, clasps, and the like or some combination thereof. In any event, it is desirable that the depth of the cushion selected is between about 0.5 inches and about 18 inches and more preferably about 1 inch to about 12 inches.

One particular embodiment of clamp 114 is also displayed. This embodiment is comprised of hook 121, a rubber grip 201, tension knob 116. While not required, this particular embodiment is equipped with rubber bumper 122. In a preferred embodiment, the present invention is equipped with at least one rubber bumper 122. At least one bumper 122 provides for additional security while the present invention is affixed to a toiler prior to, and during, use by providing grip on the toilet lid preferably on the back of the lid (when lid is raised).

Figure 9:
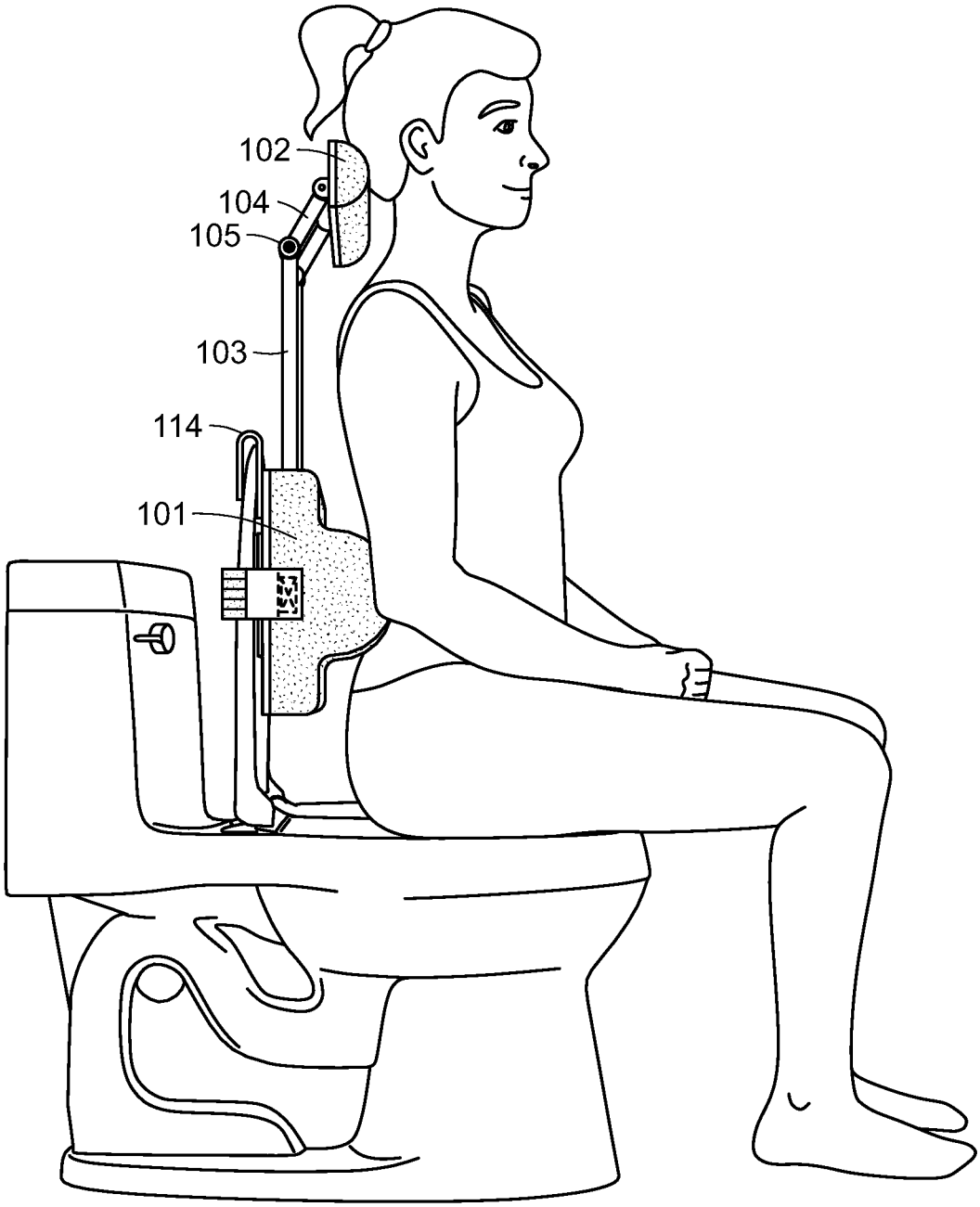
FIG. 9 is a side view of an embodiment of the present invention being used by a human user.

The risers 103 may be manually positioned and the required mechanisms manipulated in order to provide the correct configuration for support on a toilet (see FIG. 9). In other embodiments, the risers 103 and other adjustments (i.e. neck angle, etc.) may be automatically manipulated via motors or other comparable apparatus. In some embodiments, a processor and memory may be contained therein and be capable of storing particular positions for particular users or situations, thereby allowing the device to automatically be positioned in preset configurations.

Figure 3:
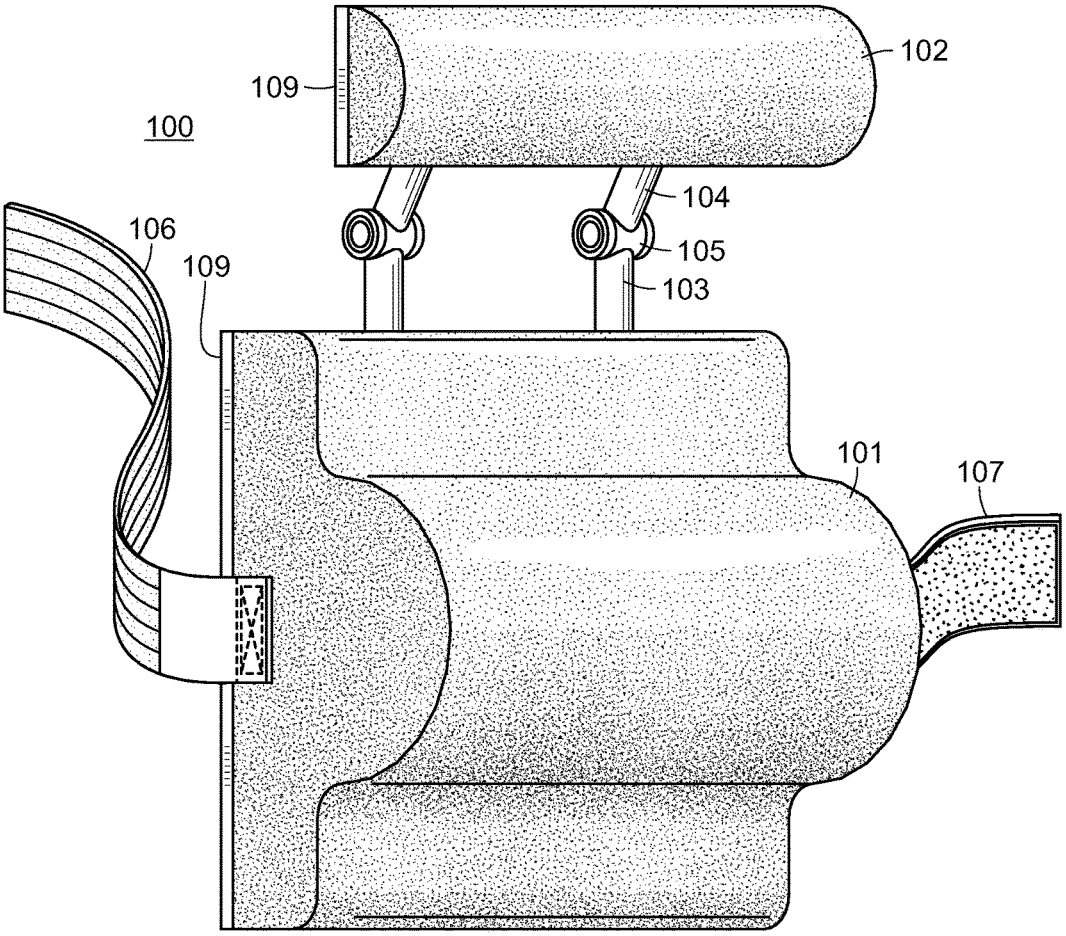
FIG. 3 is a front perspective view of an embodiment of the present invention.

Referring now to FIG. 3, there is a front view of an alternative embodiment of the invention. This embodiment of the support device 100 is comprised of a back support cushion 101, a head and neck support cushion 102, at least one riser 103, swing arm 104, pair of angle adjusters 105, strap equipped with plurality of hook fasteners 106, and strap equipped with plurality of loop fasteners 107. The hook fasteners 106 and loop fasteners 107 may be positioned on either strap in conjunction with one another. This figure shows the embodiment of the invention in a substantially extended position. However, it should be noted that pair of angle adjusters 105 may allow the risers to be collapsed or pivoted into a particular configuration for convenient carrying and storage. Further, the pair of angle adjusters 105 can adjust the position of head and neck support cushion 102 such that it provides optimal support and comfort for a user. The risers are supported by the rigid back panel 109 (see FIG. 4).

The back support cushion 101 is affixed to the lid of a toilet by strap equipped with plurality of hook fasteners 106 and strap equipped with plurality of loop fasteners 107 fastening around the tank or the lid of the toilet. In the preferred embodiment the back support cushion 101 comprises a resilient cushion or any other resilient padding material, such as polyurethane, nylon, or memory foam, having a first end and a second end. The cushion is configured in an arch shape specifically designed to conform to the curvature of the lower back, providing the proper support and positioning of the user's lower back.

In various embodiments, the strap equipped with plurality of hook fasteners 106 and the strap equipped with plurality of loop fasteners 107 are comprised of one or more elastic or fabric straps, such as nylon, polyester or other material generally known in the art, providing for constant pressure between the lumbar support portion and the seat lid. Further, while the embodiment shown here employs hook and loop fasteners to secure the support device 100 to the toilet, any other suitable non-permanent means generally known to the art of securing straps may be used in other embodiments.

Figure 4:
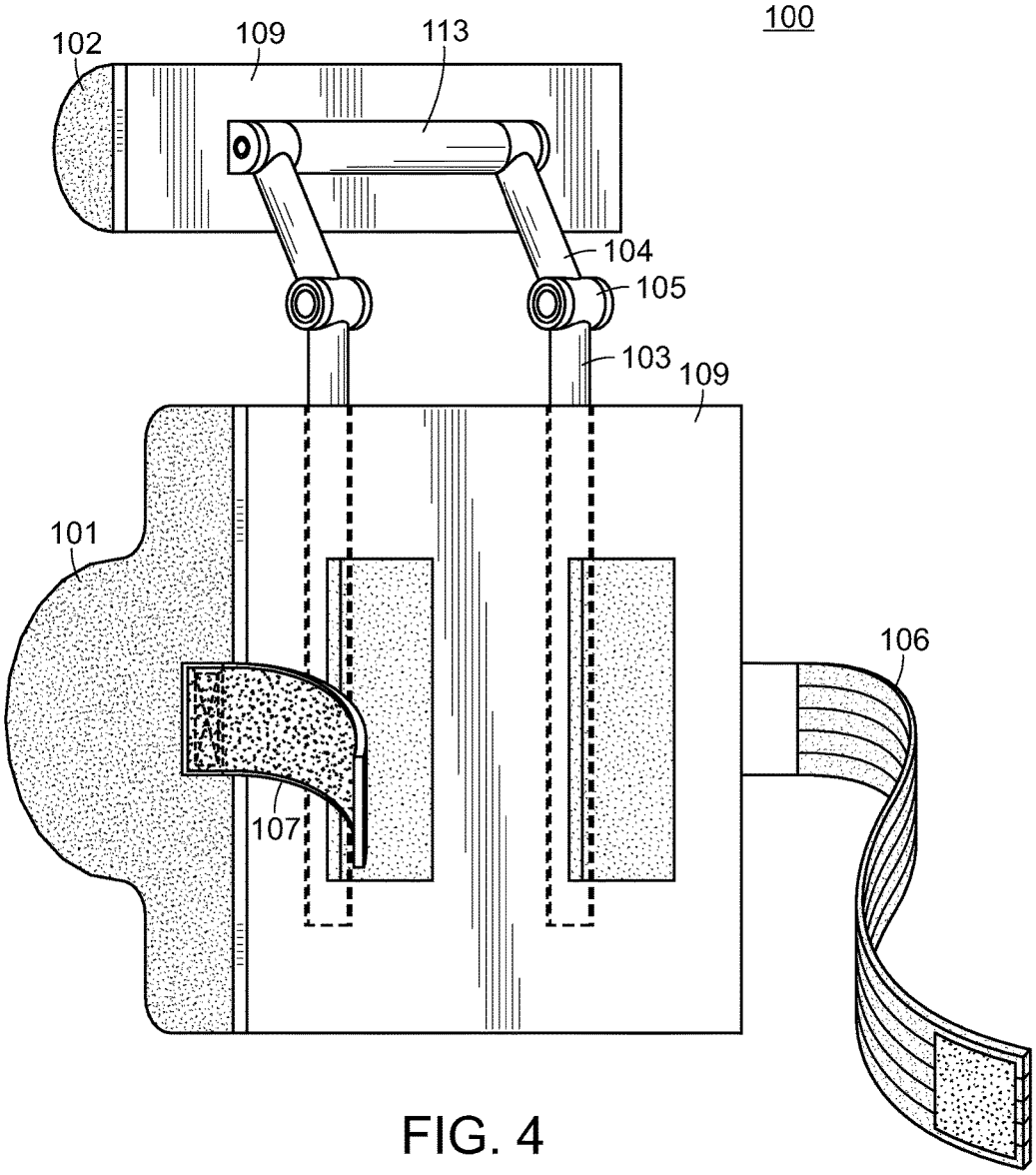
FIG. 4 is a rear view of an embodiment of the present invention, illustrating the adjustment mechanism of the risers.

Referring now to FIG. 4, there is a back view of an embodiment of the invention. FIG. 4 highlights the rigid back panel 109 that exists in some embodiments of the invention, illustrating an adjustment mechanism of the at least one riser 103. Also shown in FIG. 4 are the head and neck support cushion 102, strap equipped with plurality of hook fasteners 106, strap equipped with plurality of loop fasteners 107, at least one riser 103, swing arm 104, pair of angle adjusters 105, and the optionally equipped handle 113.

In this embodiment, the strap equipped with plurality of loop fasteners 107 and the strap equipped with plurality of hook fasteners 106 fasten to each other such that support device 100 is secured to the toilet. Further, rubber pads 108 (see FIG. 2) increase the friction between the support device 100 and the toilet on which it is being placed. This allows a user to shift their body's position while using support device 100 without the support device 100 shifting its position. The rubber pads 108 may have varying shapes, sizes, and thicknesses, and any embodiment may employ varying combinations of these pad configurations. Further the rubber pads 108 may be present on the risers 103, or strap, or other components in strategic locations to provide enhanced grip between the device and the toilet.

In a preferred embodiment, the rigid back panel 109 has one or more hollow cylindrical spaces or recesses in the top of the support serving as a means for housing one or more adjustable support rods to support the head and neck support cushion. In another embodiment, the back support cushion 109 has one or more hollow cylindrical spaces or recesses in the top of the support serving as a means for housing one or more adjustable support rods to support the head and neck support cushion. In one embodiment, the risers 103 allows for vertical adjustment of the head and neck support rod. Specifically, rigid back panel 109 allows for the head and neck support cushion 102 to connect to rigid back panel 109 by receding into the support. This may be accomplished in a similar fashion to that of an adjustable headrest on a car seat, a collapsible handle on travelers' rolling luggage, or any other means commonly known in the art.

Figure 5:
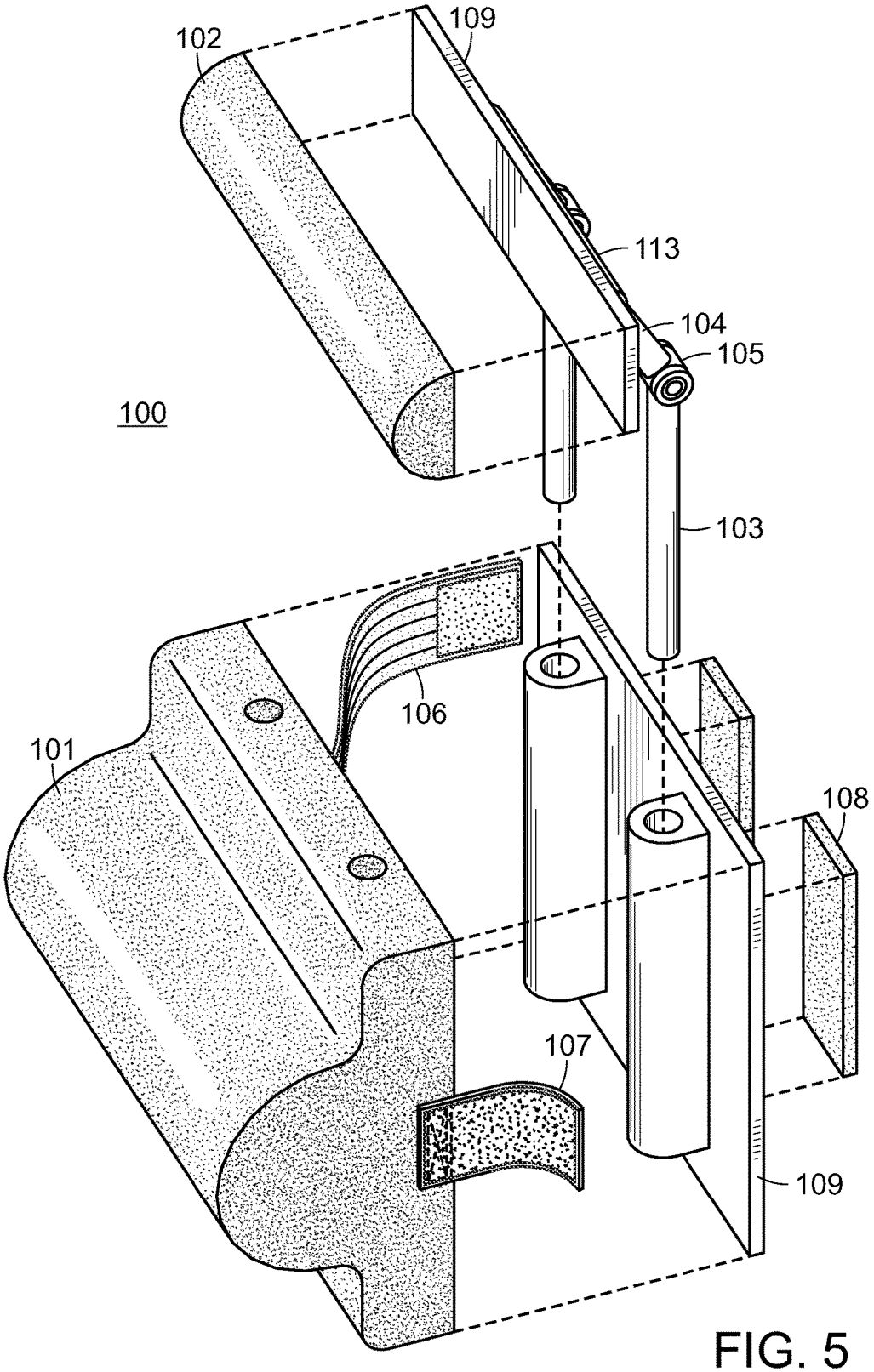
FIG. 5 is a perspective view of an alternative embodiment of the present invention, illustrating the detachable nature of the back support cushion and the neck and head support cushion.

Referring to FIG. 5, there is a front view of an embodiment of the invention wherein optional handle 113 is equipped, and the detachable nature of head and neck support cushion 102 is highlighted. In this embodiment, back support cushion 101 is readily detachable from rigid back panel 109. The detachable nature of back support cushion 101 will be beneficial regarding cleaning support device 100, traveling with support device 100, and storing support device 100 during periods of other use. There exist additional benefits not expressly stated herein. Additionally present are risers 103, swing arm 104, angle adjuster 105, hook fasteners 106, loop fasteners 107, and rubber pads 108.

Figure 6:
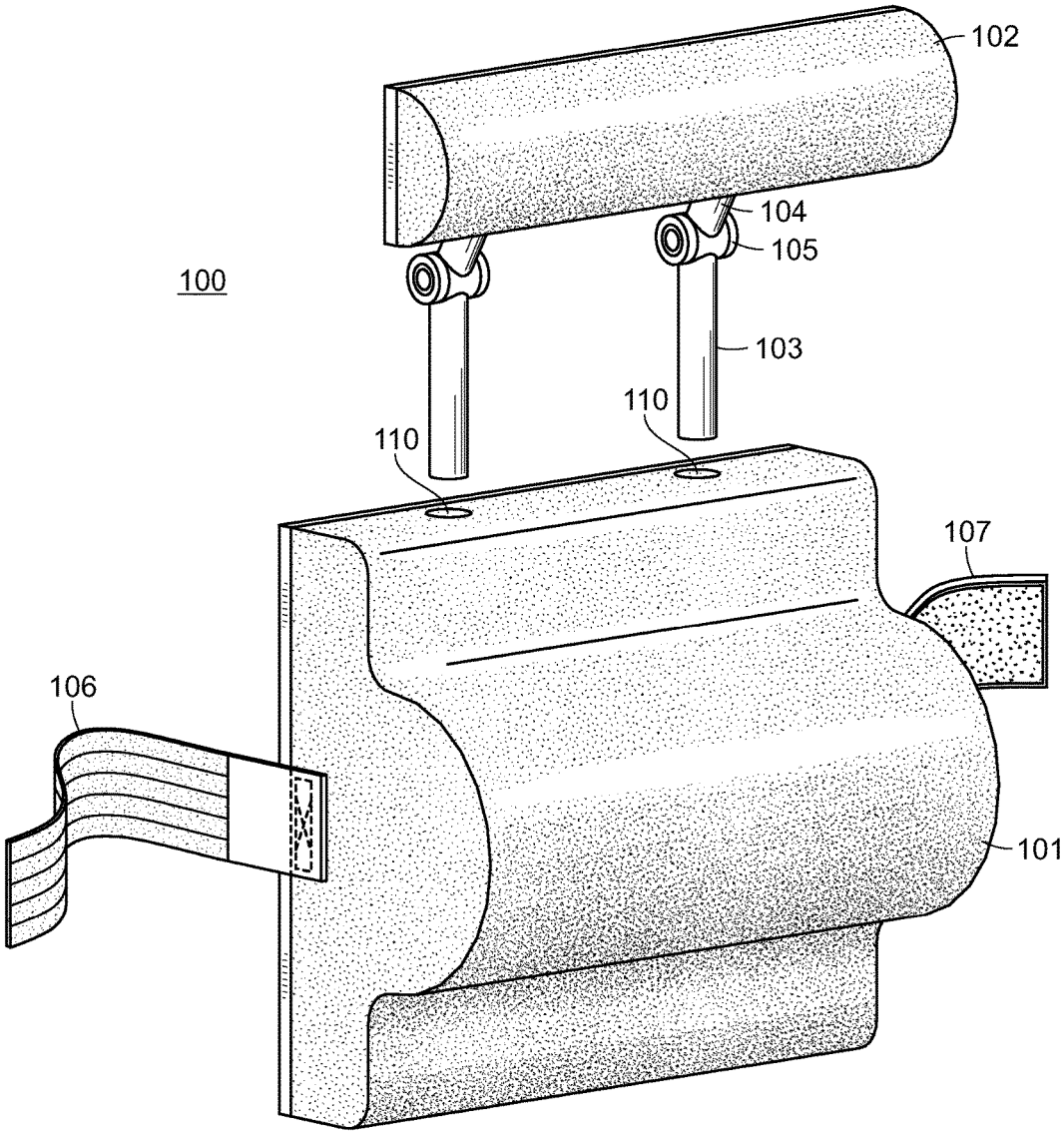
FIG. 6 is an alternative front perspective view of an embodiment of the present invention, illustrating the detachable nature of the risers.

Referring to FIG. 6, a front view of an embodiment of the invention is shown, illustrating the removable nature of the at least one riser 103, a swing arm 104, an angle adjuster 105, hook fasteners 106, and loop fasteners 107. Here, at least one riser 103 is inserted into receiving slot 110. This is achieved via a mechanism substantially similar to the adjustment mechanism of the embodiment of FIG. 5. In a preferred embodiment, the head and neck support cushion 102 comprises a curvature designed to cradle the user's neck. The neck support portion comprises a resilient cushion or other padding material such as polyurethane, nylon, memory foam, or any other supportive and comfortable material commonly known to the art.

Figure 7:
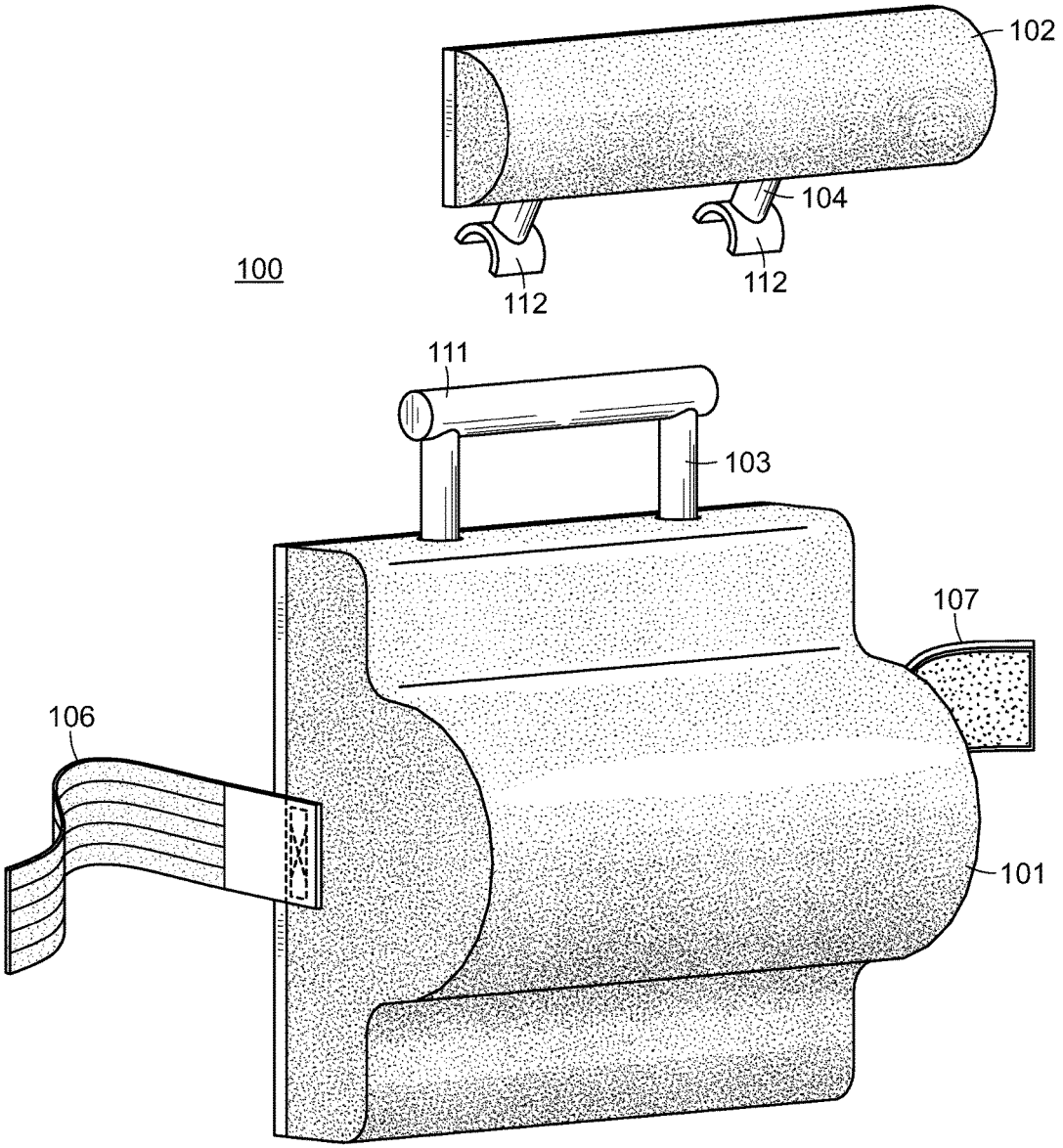
FIG. 7 is a front perspective view of an alternative embodiment of the present invention.

FIG. 7 shows an alternative embodiment of the invention wherein adjustment mechanism 111 is used to attach at least one riser 103 and swing arm 104. In this embodiment, the lower end of swing arm 104 is equipped with hooks 112. Hooks 112 are used to connect to adjustment mechanism 111. In a preferred embodiment, hooks 112 will readily be attached and detached from adjustment mechanism 111. This mechanism will provide for easy storage and will result in greater portability of support device 100. Further shown are the back support cushion 101, neck and head support cushion 102, hook fasteners 106, and loop fasteners 107.

Figure 8:
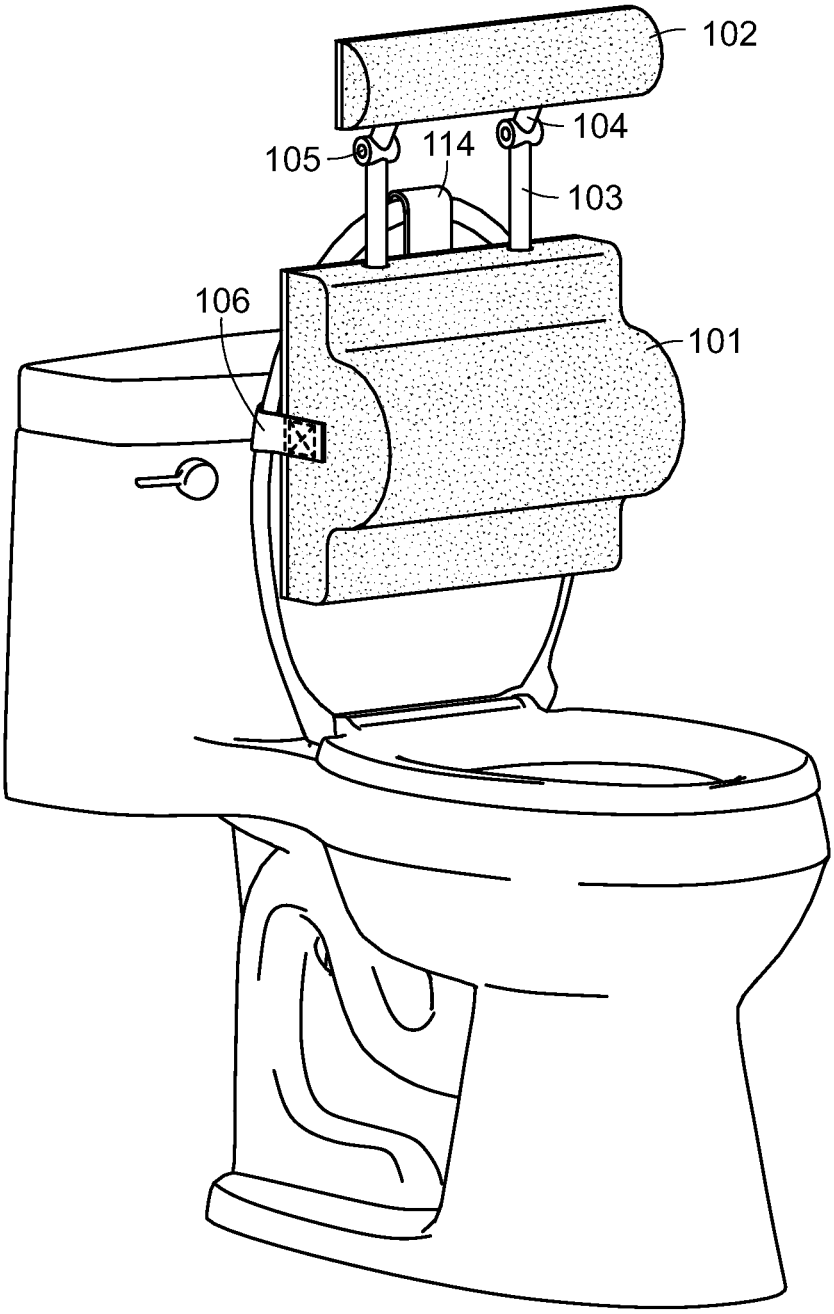
FIG. 8 is a front perspective view of an embodiment of the present invention affixed to a toilet.

FIG. 8 shows a front perspective view of support device, as described herein, affixed to a toilet wherein support device 100 is equipped with support hook 114, back cushion 101, head and neck cushion 102, risers 103, swing arm 104, and angle adjuster 105. Support hook 114 is adjustably coupled to rigid back panel to enable at least upwards and downwards adjustability of the support hook 114 relative to the support device 100. This adjustability enables the support device 100 to be adjusted such that the position of the rigid back panel in relation to a toilet lid can be modified as necessary.

FIG. 9 shows a side view of support device 100 affixed to a toilet while in use by a human user. Here, the risers 103 have been adjusted to provide the head and neck cushion 102 at the proper position to provide support to the head and neck region of a user. The swing arm 104 and angle adjuster 105 provide further flexibility in the positioning of the head and neck support cushion 102. Further, the support hook 114 has been adjusted to provide the back support cushion 101 at the correct position to provide support to the back region of a user.

Various other components may be included and called upon for providing for aspects of the teachings herein. For example, additional materials, combinations of materials and/or omission of materials may be used to provide for added embodiments that are within the scope of the teachings herein. In the present application a variety of variables are described, including but not limited to components and conditions. It is to be understood that any combination of any of these variables can define an embodiment of the disclosure. Other combinations of articles, components, conditions, and/or methods can also be specifically selected from among variables listed herein to define other embodiments, as would be apparent to those of ordinary skill in the art.

In a preferred embodiment, the clamp of the present invention is comprised of a hook 121, having a bend 203, a plurality of tips 202, and a receiving hole 204; a plurality of rubber grips 205, affixed to said plurality of tips 202; a tension knob 116, inserted into said receiving hole 204, such that it is capable of exerting tensile force upon said hook 121; and a locking knob 206, inserted into said receiving hole 204.

What is claimed is:

1. A toilet seat support device, comprising:

at least a pair of tubular rigid back members;

a padding member coupled to each of the at least a pair of tubular rigid back members;

a back cushion, attached to said at least pair of tubular rigid back members;

a back slip cover, covering said back cushion;

at least a pair of risers, wherein each of the at least a pair of risers is slidably coupled to said at least pair of tubular rigid back members;

at least a pair of of clamps, each of the at least pair of clamps being directly coupled to each of said at least pair of risers via the at least one aperture;

an adjustment mechanism, attached to at least one of said at least pair of risers;

a head cushion attached to said adjustment mechanism;

a head slip cover, covering said head cushion; and a strap, attached to said back cushion and/or said rigid back member.

2. The toilet seat support device of claim 1, further comprising at least one rubber pad attached to said at least pair of clamps.

3. The toilet seat support device of claim 1, wherein said at least one clamp is comprised of:

a hook, having a bend;

at least one rubber grip located on an end of the hook;

a tension knob, positioned such that it is capable of exerting tensile force upon said hook; and a locking knob.

4. The toilet seat support device of claim 1, wherein said head slip cover and said back slip cover are removable.

5. The toilet seat support device of claim 1, wherein said strap is equipped with a plurality of hook fasteners and a plurality of loop fasteners.

6. A method, comprising the steps of:

securing, a support device of claim 1 to a toilet item by at least a pair of clamps;

positioning, a user on top of said item and against said support device;

aligning, a head and a neck of a user with a neck and head support cushion or said support device;

optimizing, the contact angle between said head and said neck with said neck and head support cushion;

aligning, a back of said user with a back support cushion.

7. The method of claim 6, wherein the optimizing step involves adjusting the angle and retraction of a neck and head support cushion such that the head and neck support cushion lies along the same plane as the back support cushion.

8. The method of claim 6, further comprising the step of adjusting the angle of the clamps.

* * * * *